US011313529B2

(12) United States Patent
Suzuki et al.

(10) Patent No.: US 11,313,529 B2
(45) Date of Patent: Apr. 26, 2022

(54) VEHICULAR LAMP FOR FORMING DIFFERENT LIGHT DISTRIBUTION PATTERNS

(71) Applicant: Ichikoh Industries, Ltd., Isehara (JP)

(72) Inventors: Eiji Suzuki, Isehara (JP); Katsuhiko Inoue, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/254,007

(22) PCT Filed: Jun. 13, 2019

(86) PCT No.: PCT/JP2019/023565
§ 371 (c)(1),
(2) Date: Dec. 18, 2020

(87) PCT Pub. No.: WO2019/244783
PCT Pub. Date: Dec. 26, 2019

(65) Prior Publication Data

US 2021/0270438 A1 Sep. 2, 2021

(30) Foreign Application Priority Data

Jun. 21, 2018 (JP) ..... JP2018-117760

(51) Int. Cl.
*F21S 41/26* (2018.01)
*F21S 41/141* (2018.01)
(Continued)

(52) U.S. Cl.
CPC ..... *F21S 41/26* (2018.01); *F21S 41/141* (2018.01); *F21S 41/285* (2018.01); *F21S 41/43* (2018.01)

(58) Field of Classification Search
CPC ..... F21S 41/26; F21S 41/43; F21S 41/285
See application file for complete search history.

(56) References Cited

U.S. PATENT DOCUMENTS

2005/0219856 A1 10/2005 Tatsukawa
2007/0291499 A1 12/2007 Tanaka
2009/0097268 A1 4/2009 Mochizuki

FOREIGN PATENT DOCUMENTS

JP 2005-294176 A 10/2005
JP 2007-335301 A 12/2007
(Continued)

OTHER PUBLICATIONS

International Search Report dated Aug. 13, 2019 in PCT/JP2019/023565 filed Jun. 13, 2019, 2 pages.

*Primary Examiner* — Robert J May
(74) *Attorney, Agent, or Firm* — Oblon, McClelland, Maier & Neustadt, L.L.P.

(57) ABSTRACT

A vehicular lamp (10) includes: a condensing unit (12) including a condensing upper emitting unit (22, 23) for a condensing upper pattern (65, 67, 68), a condensing lower emitting unit (21, 31) for a condensing lower pattern (63, 64, 66), and a condensing projection lens (24, 34) that projects light from the condensing upper emitting unit and the condensing lower emitting unit; and a diffusion unit (13) including a diffusion upper emitting unit (42) for a diffusion upper pattern (73); a diffusion lower emitting unit (41) for a diffusion lower pattern (71, 72), and a diffusion projection lens (44) that projects light from the diffusion upper emitting unit and the diffusion lower emitting unit, the condensing lower pattern and the diffusion lower pattern form a passing light distribution pattern (LP), and the condensing upper pattern and a diffusion upper pattern (73) form a traveling light distribution pattern (HP).

8 Claims, 7 Drawing Sheets

(51) Int. Cl.
*F21S 41/43* (2018.01)
*F21S 41/20* (2018.01)

(56) References Cited

FOREIGN PATENT DOCUMENTS

| | | | |
|---|---|---|---|
| JP | 2009-94014 | A | 4/2009 |
| JP | 2012-151058 | A | 8/2012 |

FIG. 11A
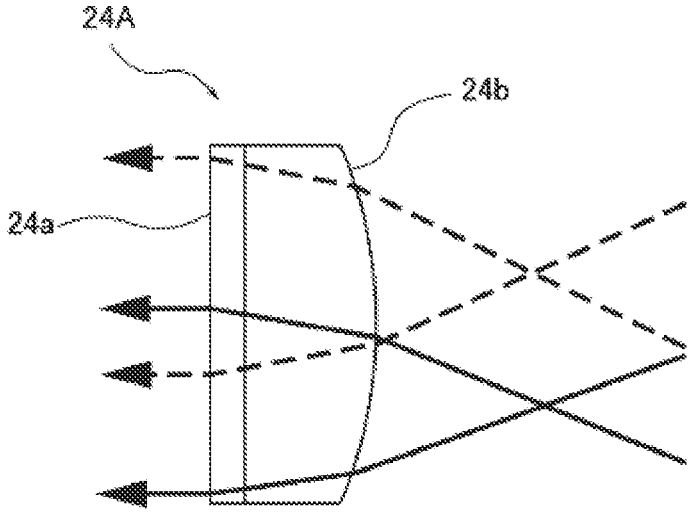
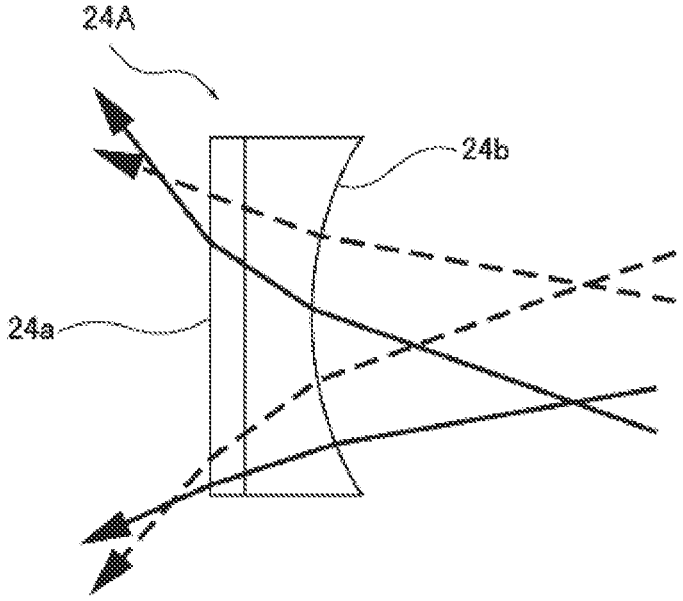
FIG. 11B

VEHICULAR LAMP FOR FORMING DIFFERENT LIGHT DISTRIBUTION PATTERNS

TECHNICAL FIELD

The present invention relates to a vehicular lamp.

BACKGROUND ART

Some vehicular lamps are configured to switch between a passing light distribution pattern and a traveling light distribution pattern. As this kind of vehicular lamp, there is a known vehicular lamp in which a shade is provided to block part of the light from a light source and the shade is moved between a blocking position for part of the light and a non-blocking position to switch between a passing light distribution pattern and a traveling light distribution pattern (see, for example, Patent Literature 1). The vehicular lamp includes the shade that is rotatable between the blocking position for part of the light and the non-blocking position, and the shade is displaced to either of the two positions by a drive mechanism.

CITATION LIST

Patent Literature

PTL 1: Japanese Patent Application Publication No. 2012-151058

SUMMARY OF THE INVENTION

Problems to be Solved by the Invention

Unfortunately, the conventional vehicular lamp needs to include the drive mechanism that displaces the shade, which results in an increase in size and weight.

The present disclosure has been made in view of the above-described circumstances and has an object to provide a vehicular lamp with which it is possible to switch between a passing light distribution pattern and a traveling light distribution pattern while preventing an increase in size and weight.

Means for Solving the Problem

A vehicular lamp according to the present disclosure includes a condensing unit that forms a condensing light distribution pattern and a diffusion unit that forms a diffusion light distribution pattern that is formed in a wider area than the condensing light distribution pattern and that is at least partially overlapped with the condensing light distribution pattern, wherein the condensing unit includes a condensing upper emitting unit that emits light for forming a condensing upper pattern that is an upper portion of the condensing light distribution pattern, a condensing lower emitting unit that emits light for forming a condensing lower pattern that is a lower portion of the condensing light distribution pattern, and a condensing projection lens that projects light emitted from the condensing upper emitting unit and the condensing lower emitting unit to a front side in an optical axis direction; the diffusion unit includes a diffusion upper emitting unit that emits light for forming a diffusion upper pattern that is an upper portion of the diffusion light distribution pattern, a diffusion lower emitting unit that emits light for forming a diffusion lower pattern that is a lower portion of the diffusion light distribution pattern, and a diffusion projection lens that projects light emitted from the diffusion upper emitting unit and the diffusion lower emitting unit to the front side in the optical axis direction; the condensing lower pattern and the diffusion lower pattern form a passing light distribution pattern; and the condensing upper pattern and the diffusion upper pattern form a traveling light distribution pattern.

Effect of the Invention

With a vehicular lamp according to the present disclosure, it is possible to switch between a passing light distribution pattern and a traveling light distribution pattern while preventing an increase in size and weight.

BRIEF DESCRIPTION OF THE DRAWINGS

FIG. 11A and FIG 11B are explanatory diagrams illustrating a condensing oblique projection lens according to another example.

MODE FOR CARRYING OUT THE INVENTION

A first embodiment of a vehicular lamp 10 is described below as an embodiment of a vehicular lamp according to the present disclosure with reference to FIGS. 1 to 11B. In FIGS. 3, 5, 6, 8, and 9, lower patterns (63, 64, 66, 71, 72) forming a passing light distribution pattern LP are attached with different hatches or dots in the illustration so as to be easily distinguished from each other.

The vehicular lamp 10 is used as a lamp such as a headlamp or a fog lamp used in a vehicle such as an automobile and, in the example described according to the first embodiment, is used as a headlamp. The vehicular lamp 10 is installed, via a vertical-direction optical axis adjustment mechanism and a width-direction optical axis adjustment mechanism, in a lamp chamber 11 (see FIG. 1) that is formed by covering the opened front end of a lamp housing with an outer lens on both the right and left sides of the front of the vehicle. In the following description, the direction in which the vehicle travels in a straight line and in which light is emitted by the vehicular lamp 10 is an optical axis direction (front side), the vertical direction when the vehicular lamp 10 is installed in the vehicle is a vertical direction, and the direction perpendicular to the optical axis direction and the vertical direction is a width direction.

Figure 1:
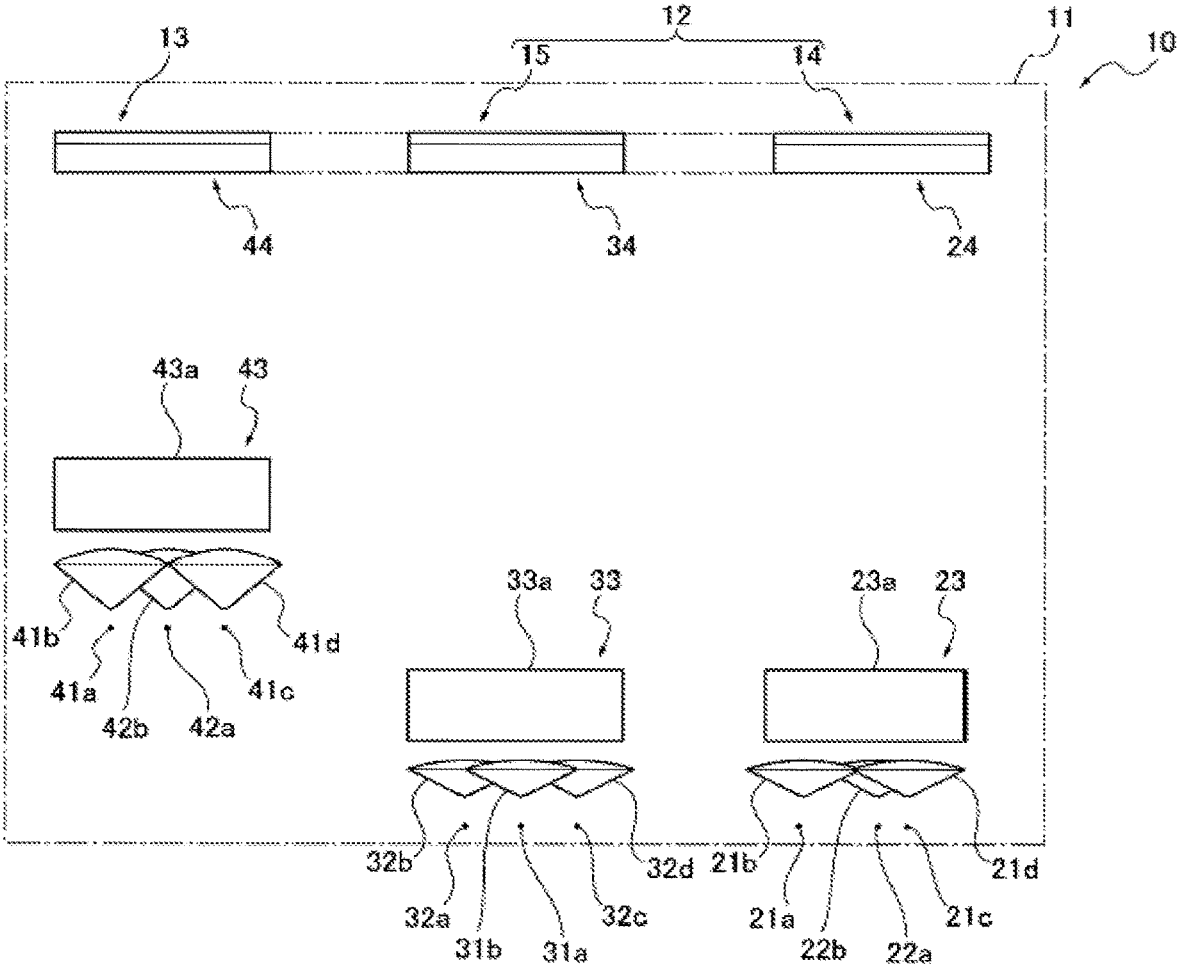
FIG. 1 is an explanatory diagram illustrating a configuration of a vehicular lamp that is an example according to an embodiment of a vehicular lamp according to the present disclosure.

As illustrated in FIG. 1, the vehicular lamp 10 includes a condensing unit 12 that forms a condensing light distribution pattern 60 (see FIG. 6) and a diffusion unit 13 that forms a diffusion light distribution pattern 70 (see FIG. 8) for illuminating a wider area than that of the condensing light distribution pattern 60. The condensing unit 12 and the diffusion unit 13 form the condensing light distribution pattern 60 and the diffusion light distribution pattern 70 such that at least part thereof is overlapped with each other so as to form a traveling light distribution pattern HP and the passing light distribution pattern LP as described below (see FIG. 9).

Figure 5:
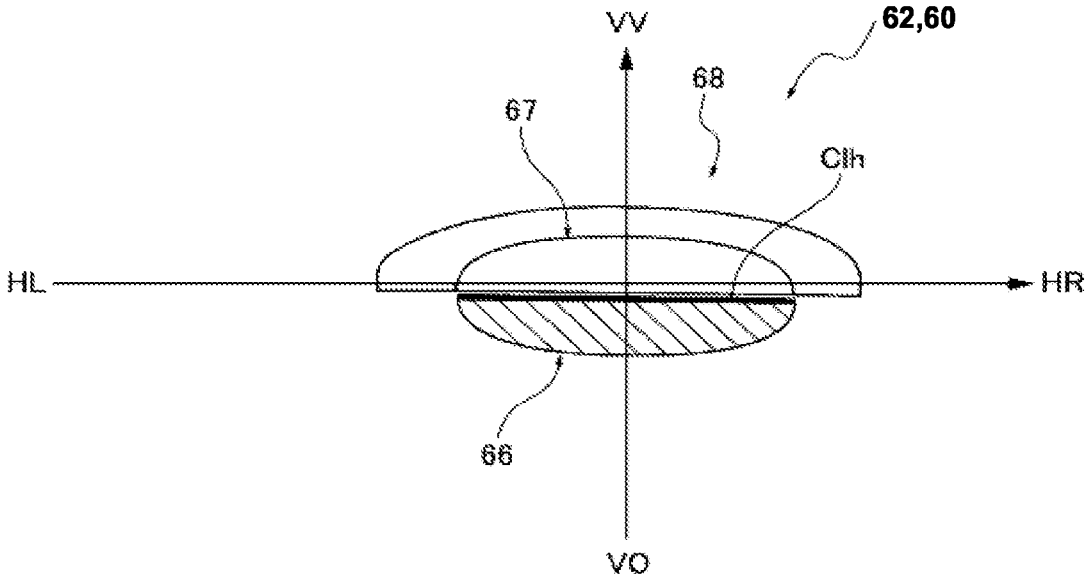
FIG. 5 is an explanatory diagram illustrating a condensing horizontal light distribution pattern.

The condensing unit 12 according to the first embodiment includes a condensing oblique unit 14 that forms a condensing oblique light distribution pattern 61 (see FIG. 3) and a condensing horizontal unit 15 that forms a condensing horizontal light distribution pattern 62 (see FIG. 5). The condensing oblique unit 14 and the condensing horizontal unit 15 form the condensing oblique light distribution pattern 61 and the condensing horizontal light distribution pattern 62 such that at least part thereof is overlapped with each other so as to form the condensing light distribution pattern 60 (see FIG. 3). The condensing oblique unit 14, the condensing horizontal unit 15, and the above-described diffusion unit 13 are arranged side by side in the horizontal direction according to the first embodiment. The arrangement order, the arrangement direction, and the positional relationship of the units (14, 15, 13) may be set as appropriate as long as the traveling light distribution pattern HP and the passing light distribution pattern LP may be formed as described below, and are not limited to the configuration according to the first embodiment.

Figure 2:
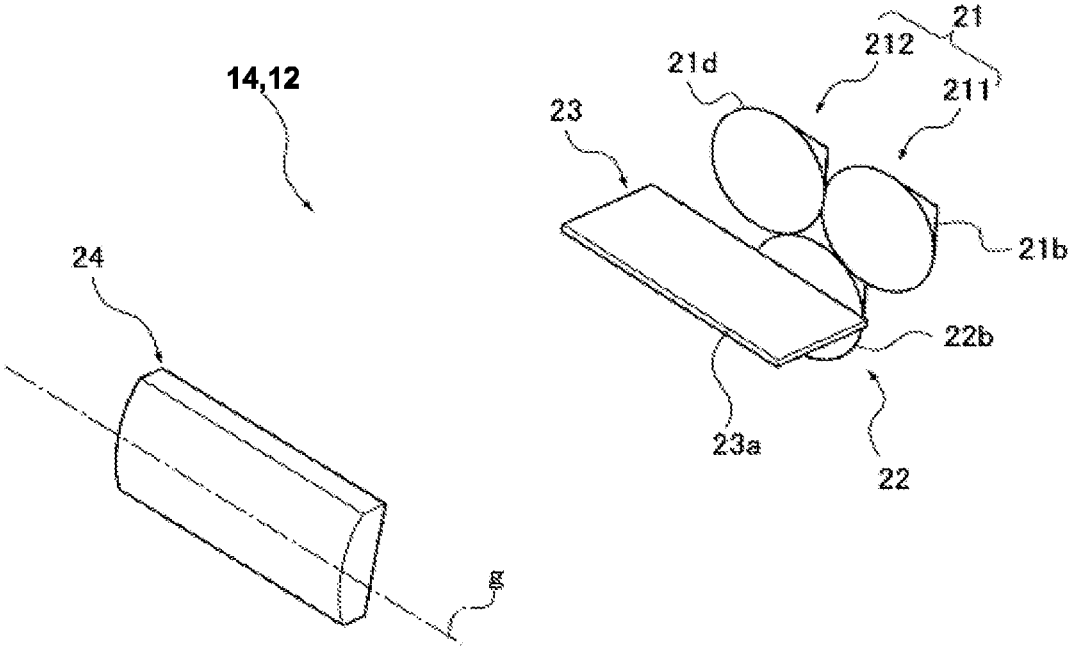
FIG. 2 is an explanatory diagram illustrating a condensing oblique unit.

As illustrated in FIG. 2, the condensing oblique unit 14 includes a condensing oblique lower emitting unit 21, a condensing oblique upper emitting unit 22, a condensing oblique shade 23, and a condensing oblique projection lens 24. The condensing oblique lower emitting unit 21 includes a first condensing oblique lower emitting unit 211 including a first lower light source 21*a* (see FIG. 1) and a first lower lens 21*b* and a second condensing oblique lower emitting unit 212 including a second lower light source 21*c* (see FIG. 1) and a second lower lens 21*d*. The lower emitting units (211, 212) are arranged side by side at a tilt with respect to the horizontal plane such that the second condensing oblique lower emitting unit 212 is located above the first condensing oblique lower emitting unit 211. According to the first embodiment, the line connecting the center lines (optical axes) of the lower emitting units (211, 212) is tilted with respect to the horizontal plane such that an oblique portion Cls (see FIG. 3) of the first condensing oblique lower pattern 63 and the second condensing oblique lower pattern 64 described below is tilted with respect to the horizontal plane at approximately 15 degrees.

The first lower light source 21*a* and the second lower light source 21*c* each include a light emitting element such as a light emitting diode (LED) and are mounted on the identical board. The board may feed an electric power from a lighting control circuit to the first lower light source 21*a* and the second lower light source 21*c* as appropriate to turn on the first lower light source 21*a* and the second lower light source 21*c* all together or individually as appropriate.

The first lower lens 21*b* corresponds to the first lower light source 21*a* and is provided on the front side of the first lower light source 21*a* in the optical axis direction. When viewed on the cross-section perpendicular to the vertical direction, the first lower lens 21*b* has a free-form surface based on an ellipse having a first focal point positioned near the first lower light source 21*a* and a second focal point positioned near an end 23*a* of the condensing oblique shade 23. When viewed on the cross-section perpendicular to the horizontal direction, the first lower lens 21*b* has substantially a paraboloidal surface having the focal point positioned near the first lower light source 21*a*. The first lower lens 21*b* has an optical design to form the light emitted from the first lower light source 21*a* so as to form the first condensing oblique lower pattern 63 (see FIG. 3) in cooperation with the condensing oblique projection lens 24. The first condensing oblique lower pattern 63 according to the first embodiment is to illuminate the semi-circular elongated area diagonally downward of the oblique portion Cls described below.

The second lower lens 21*d* corresponds to the second lower light source 21*c* and is provided on the front side of the second lower light source 21*c* in the optical axis direction. The second lower lens 21*d* has the same configuration as that of the first lower lens 21*b* except that the second lower lens 21*d* corresponds to the second lower light source 21*c* instead of the first lower light source 21*a*. The second lower lens 21*d* has an optical design to form the light emitted from the second lower light source 21*c* so as to form the second condensing oblique lower pattern 64 (see FIG. 3) in cooperation with the condensing oblique projection lens 24. The second condensing oblique lower pattern 64 according to the first embodiment is to illuminate the elongated area including the entire first condensing oblique lower pattern 63, the small area diagonally rightward and downward of the first condensing oblique lower pattern 63, and the large area on the left side of the first condensing oblique lower pattern 63.

The condensing oblique upper emitting unit 22 is provided lower than and between the first condensing oblique lower emitting unit 211 and the second condensing oblique lower emitting unit 212 and, when viewed from the front side in the optical axis direction, is provided to have a triangular positional relationship with the two lower emitting units (211, 212). The condensing oblique upper emitting unit 22 is displaced diagonally upward toward the second condensing oblique lower emitting unit 212 in conformity with the tilt of the two lower emitting units (211, 212) with respect to the horizontal plane.

The condensing oblique upper emitting unit 22 includes an upper light source 22*a* (see FIG. 1) and an upper lens 22*b*. The upper light source 22*a* includes a light emitting element such as an LED and is mounted on the board on which the first lower light source 21*a* and the second lower light source 21*c* are mounted. The board may also feed an electric power from the lighting control circuit to the upper light source 22*a* as appropriate so as to turn on the upper light source 22*a* together with or separately from the first lower light source 21*a* and the second lower light source 21*c*. The light sources (21*a*, 21*c*, 22*a*) may be provided on different boards, or only two of the light sources may be provided on the same board; thus, the configuration according to the first embodiment is not a limitation.

The upper lens 22*b* corresponds to the upper light source 22*a* and is provided on the front side of the upper light source 22*a* in the optical axis direction. The upper lens 22*b* has the same configuration as that of the first lower lens 21*b* except that the upper lens 22*b* corresponds to the upper light source 22*a* instead of the first lower light source 21*a*. The upper lens 22*b* has an optical design to form the light emitted from the upper light source 22*a* so as to form a condensing oblique upper pattern 65 (see FIG. 3) in cooperation with the condensing oblique projection lens 24. The condensing oblique upper pattern 65 according to the first embodiment is to illuminate the semi-circular elongated area diagonally upward of the oblique portion Cls described below.

The condensing oblique shade 23 functions as a condensing shade and is a thin plate-shaped member to block part of the light emitted from the condensing oblique lower emitting unit 21 so as to form the oblique portion Cls (see FIG. 3) of the first condensing oblique lower pattern 63 and the second condensing oblique lower pattern 64. The oblique portion Cls includes an oblique portion that is part of a cutoff line Cl of the passing light distribution pattern LP (see FIG. 9). The condensing oblique shade 23 is provided in front of the two lower light emitting units (211, 212) and the condensing oblique upper emitting unit 22, is located at the position corresponding to the position between the condensing oblique lower emitting unit 21 and the condensing oblique upper emitting unit 22, and is arranged parallel to the direction in which the two lower emitting units (211, 212) are arranged so as to be tilted with respect to the horizontal plane. As the condensing oblique shade 23 is provided to have the above-described positional relationship according to the first embodiment, it is assumed that the condensing oblique shade 23 blocks part of the light emitted from the condensing oblique upper emitting unit 22 so that the left lower end of the condensing oblique upper pattern 65 has a linear shape along the oblique portion Cls (See FIG. 3).

The condensing oblique projection lens 24 projects the light emitted from the two lower emitting units (211, 212) and the condensing oblique upper emitting unit 22 toward the front side of the vehicle. The condensing oblique projection lens 24 according to the first embodiment includes a cylindrical lens that extends in the width direction and has a refractive power exclusively in the vertical direction (a convex lens or a concave lens on the cross-section perpendicular to the width direction) and has a rear focus line that is set near the end 23*a* of the condensing oblique shade 23 and is set along the end 23*a*. The condensing oblique projection lens 24 according to the first embodiment is tilted such that a generating line g (a line in the shape of the optical plane extending in a direction perpendicular to the optical axis and in a direction having no refractive power) is displaced in conformity with the condensing oblique shade 23, that is, diagonally upward toward the second condensing oblique lower emitting unit 212. The condensing oblique projection lens 24 according to the first embodiment has, from the front side in the optical axis direction, a horizontally elongated and substantially rectangular shape on the projection surface, and the generating line g is tilted with respect to the elongating direction (see FIG. 10). In other words, the condensing oblique projection lens 24 has a shape that is formed by cutting out, in the horizontal direction, the upper end and the lower end of the cylindrical lens indicated in a broken line with the oblique generating line g, and the shape on the projection surface described above is substantially identical to that of a condensing horizontal projection lens 34 and a diffusion projection lens 44 described below (see FIG. 10). The condensing oblique projection lens 24 forms the first condensing oblique lower pattern 63 with the light from the first condensing oblique lower emitting unit 211, forms the second condensing oblique lower pattern 64 with the light from the second condensing oblique lower emitting unit 212, and forms the condensing oblique upper pattern 65 with the light from the condensing oblique upper emitting unit 22 (see FIG. 3).

The condensing oblique unit 14 is formed by fixing the condensing oblique lower emitting unit 21, the condensing oblique upper emitting unit 22, the condensing oblique shade 23, and the condensing oblique projection lens 24 to a fixing member in the above-described positional relationship. As the fixing member, for example, a heatsink may be used, which is a heat release member that releases the heat generated by each of the light sources (21*a*, 21*c*, 22*a*) of the emitting units (21, 22) to the outside.

Figure 3:
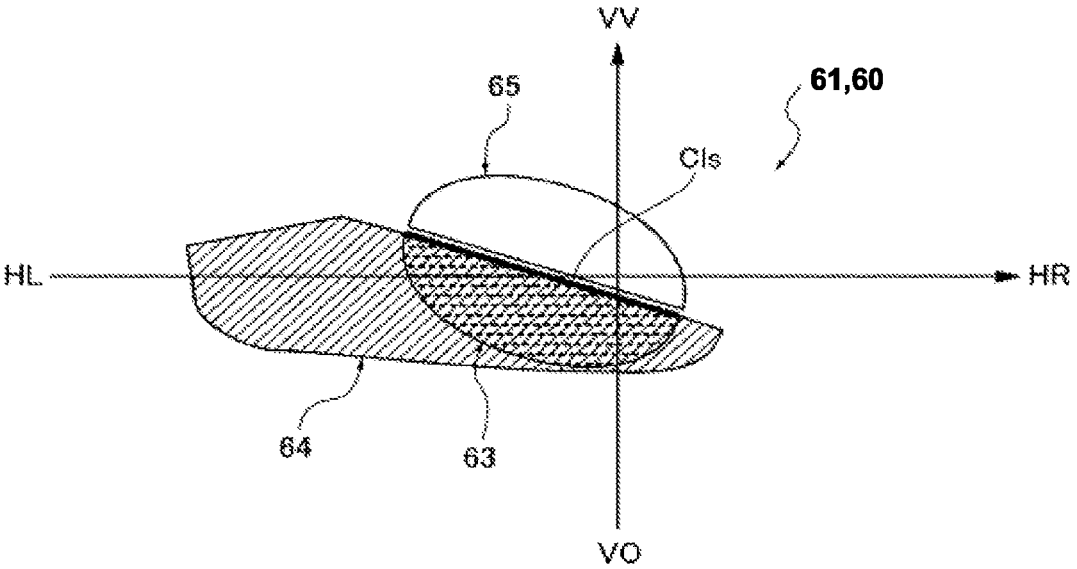
FIG. 3 is an explanatory diagram illustrating a condensing oblique light distribution pattern.

In the condensing oblique unit 14, the electric power from the lighting control circuit is supplied from the board to each of the light sources (21*a*, 21*c*, 22*a*) to turn on the emitting units (211, 212, 22) all together or individually as appropriate so as to form the above-described light distribution patterns (63, 64, 65) all together or individually as illustrated in FIG. 3. The first condensing oblique lower pattern 63 and the second condensing oblique lower pattern 64 are overlapped with each other near the center including the oblique portion Cls. Therefore, when the two oblique lower patterns (63, 64) are simultaneously formed, the lower portion including the oblique portion Cls may be brightened, and a clear shadow above and below the oblique portion Cls may be made. The condensing oblique upper pattern 65 is formed above the two oblique lower patterns (63, 64) such that the condensing oblique upper pattern 65 is substantially overlapped with the oblique portion Cls. The oblique portion Cls is tilted at approximately 15 degrees with respect to the horizontal plane due to the positional relationship among the condensing oblique lower emitting unit 21, the condensing oblique upper emitting unit 22, the condensing oblique shade 23, and the condensing oblique projection lens 24 and the optical design.

Figure 4:
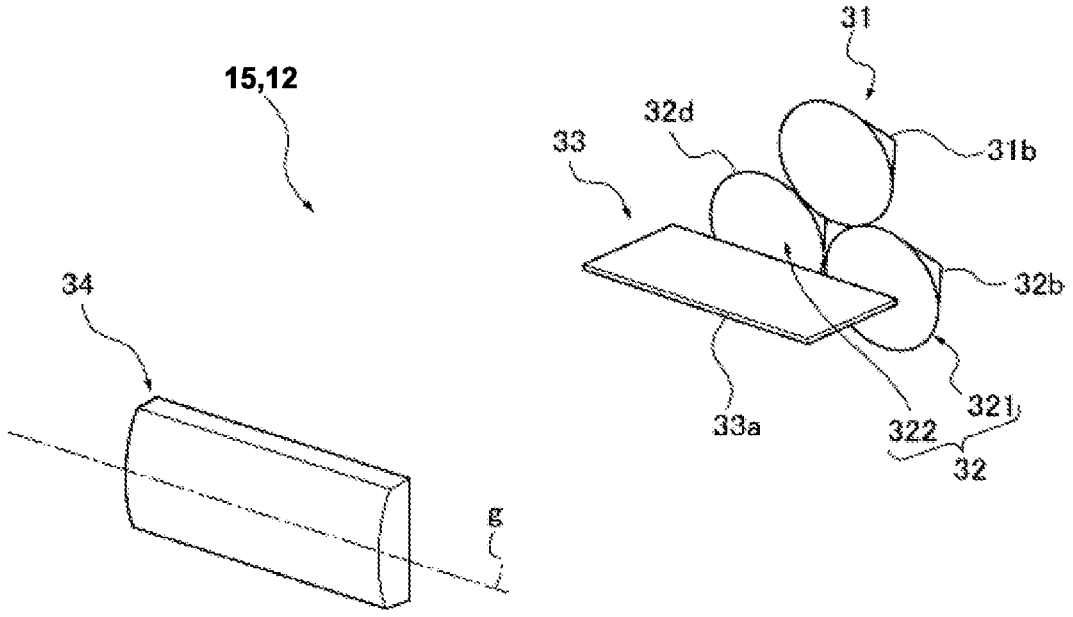
FIG. 4 is an explanatory diagram illustrating a condensing horizontal unit.

As illustrated in FIG. 4, the condensing horizontal unit 15 includes a condensing horizontal lower emitting unit 31, a condensing horizontal upper emitting unit 32, a condensing horizontal shade 33, and the condensing horizontal projection lens 34. The condensing horizontal lower emitting unit 31 includes a lower light source 31*a* (see FIG. 1) and a lower lens 31*b*. The lower light source 31*a* includes a light emitting element such as an LED and is mounted on a board. The board may also feed an electric power from a lighting control circuit to the lower light source 31*a* as appropriate to turn on the lower light source 31*a* as appropriate.

The lower lens 31*b* corresponds to the lower light source 31*a* and is provided on the front side of the lower light source 31*a* in the optical axis direction. When viewed on the cross-section perpendicular to the vertical direction, the lower lens 31*b* has a free-form surface based on an ellipse having a first focal point positioned near the lower light source 31*a* and a second focal point positioned near an end 33*a* of the condensing horizontal shade 33. When viewed on the cross-section perpendicular to the horizontal direction, the lower lens 31*b* has substantially a paraboloidal surface having the focal point positioned near the lower light source 31*a*. The lower lens 31*b* has an optical design to form the light emitted from the lower light source 31*a* so as to form the condensing horizontal lower pattern 66 (see FIG. 5) in cooperation with the condensing horizontal projection lens 34. The condensing horizontal lower pattern 66 according to the first embodiment is to illuminate the semi-circular elongated area under a horizontal portion Clh described below.

The condensing horizontal upper emitting unit 32 includes a first condensing horizontal upper emitting unit 321 including a first upper light source 32*a* (see FIG. 1) and a first upper lens 32*b* and a second condensing horizontal upper emitting unit 322 including a second upper light source 32*c* (see FIG. 1) and a second upper lens 32*d*. The first condensing horizontal upper emitting unit 321 and the second condensing horizontal upper emitting unit 322 are arranged side by side in the horizontal direction above the condensing horizontal lower emitting unit 31. When viewed from the front side in the optical axis direction, the two upper emitting units (321, 322) are arranged to have a triangular positional relationship with the condensing horizontal lower emitting unit 31.

The first upper light source 32*a* and the second upper light source 32*c* each include a light emitting element such as an LED and are mounted on the board on which the lower light source 31*a* is mounted. The board may also feed an electric power from the lighting control circuit to the first upper light source 32*a* and the second upper light source 32*c* as appropriate to turn on the first upper light source 32*a* and the second upper light source 32*c* together with or separately from the lower light source 31*a*. Each of the light sources (31*a*, 32*a*, 32*c*) may be provided on different boards or only two of the light sources may be provided on the same board; thus, the configuration according to the first embodiment is not a limitation.

The first upper lens 32*b* corresponds to the first upper light source 32*a* and is provided on the front side of the first upper light source 32*a* in the optical axis direction. The first upper lens 32*b* has the same configuration as that of the lower lens 31*b* except that the first upper lens 32*b* corresponds to the first upper light source 32*a* instead of the lower light source 31*a*. The first upper lens 32*b* has an optical design to form the light emitted from the first upper light source 32*a* so as to form a first condensing horizontal upper pattern 67 (see FIG. 5) in cooperation with the condensing horizontal projection lens 34. The first condensing horizontal upper pattern 67 according to the first embodiment is to illuminate the semi-circular elongated area above the horizontal portion Clh described below.

The second upper lens 32*d* corresponds to the second upper light source 32*c* and is provided on the front side of the second upper light source 32*c* in the optical axis direction. The second upper lens 32*d* has the same configuration as that of the lower lens 31*b* except that the second upper lens 32*d* corresponds to the second upper light source 32*c* instead of the lower light source 31*a*. The second upper lens 32*d* has an optical design to form the light emitted from the second upper light source 32*c* so as to form a second condensing horizontal upper pattern 68 (see FIG. 5) in cooperation with the condensing horizontal projection lens 34. The second condensing horizontal upper pattern 68 according to the first embodiment is to illuminate the area that includes the entire first condensing horizontal upper pattern 67 and that is wider than the first condensing horizontal upper pattern 67 upward and horizontally.

The condensing horizontal shade 33 functions as a condensing shade and is a thin plate-shaped member to block part of the light emitted from the condensing horizontal lower emitting unit 31 so as to form the horizontal portion Clh (see FIG. 5) of the condensing horizontal lower pattern 66. The horizontal portion Clh includes a horizontal portion that is part of the cutoff line Cl of the passing light distribution pattern LP (see FIG. 9). The condensing horizontal shade 33 is provided in front of the condensing horizontal lower emitting unit 31 and the condensing horizontal upper emitting unit 32, is located at the position corresponding to the position between the condensing horizontal lower emitting unit 31 and the condensing horizontal upper emitting unit 32, and is arranged parallel to the direction in which the two upper emitting units (321, 322) are arranged so as to be parallel to the horizontal plane. As the condensing horizontal shade 33 has the above-described positional relationship according to the first embodiment, the condensing horizontal shade 33 also blocks part of the light emitted from the condensing horizontal upper emitting unit 32 so that the lower ends of the first condensing horizontal upper pattern 67 and the second condensing horizontal upper pattern 68 have a linear shape along the horizontal portion Clh (see FIG. 5).

The condensing horizontal projection lens 34 projects the light emitted from the condensing horizontal lower emitting unit 31 and the two upper emitting units (321, 322) toward the front side of the vehicle. The condensing horizontal projection lens 34 according to the first embodiment includes a cylindrical lens that extends in the width direction and has a refractive power exclusively in the vertical direction, has the generating line g extending along the horizontal direction (see FIG. 10), and has a rear focus line that is set near the end 33*a* of the condensing horizontal shade 33 and is set along the end 33*a*. The condensing horizontal projection lens 34 according to the first embodiment has, when viewed from the front side in the optical axis direction, a rectangular shape on the projection surface, and the shape is substantially identical to the shape of the condensing oblique projection lens 24 on the projection surface (see FIG. 10). The condensing horizontal projection lens 34 forms the condensing horizontal lower pattern 66 with the light from the condensing horizontal lower emitting unit 31, forms the first condensing horizontal upper pattern 67 with the light from the first condensing horizontal upper emitting unit 321, and forms the second condensing horizontal upper pattern 68 with the light from the second condensing horizontal upper emitting unit 322 (see FIG. 5).

The condensing horizontal unit 15 is formed by fixing the condensing horizontal lower emitting unit 31, the condensing horizontal upper emitting unit 32, the condensing horizontal shade 33, and the condensing horizontal projection lens 34 to a fixing member in the above-described positional relationship. As the fixing member, for example, a heatsink may be used, which is a heat release member that releases the heat generated by each of the light sources (31*a*, 32*a*, 32*c*) of the emitting units (31, 32) to the outside. In the condensing horizontal unit 15, the condensing horizontal projection lens 34 is arranged alongside of the condensing oblique projection lens 24 of the condensing oblique unit 14 in the horizontal direction.

In the condensing horizontal unit 15, the electric power from the lighting control circuit is supplied from the board to each of the light sources (31*a*, 32*a*, 32*c*) to turn on the emitting units (31, 321, 322) all together or individually as appropriate so as to form the above-described light distribution patterns (66, 67, 68) all together or individually as illustrated in FIG. 5. The first condensing horizontal upper pattern 67 and the second condensing horizontal upper pattern 68 are formed above the condensing horizontal lower pattern 66 so as to be substantially overlapped with each other at the horizontal portion Clh. The first condensing horizontal upper pattern 67 is formed in the center, and the second condensing horizontal upper pattern 68 is formed in the area that includes the first condensing horizontal upper pattern 67 and that is wider than the first condensing horizontal upper pattern 67. Therefore, when the two horizontal upper patterns (67, 68) are simultaneously formed, a clear shadow may be made near the lower end, especially near the lower end in the center.

Figure 6:
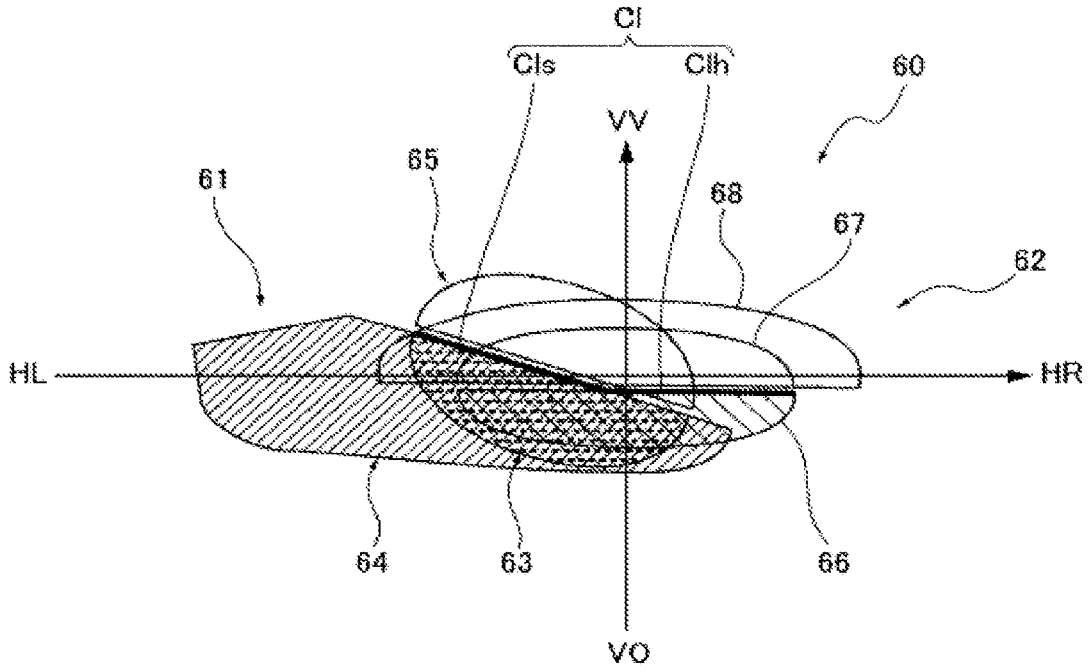
FIG. 6 is an explanatory diagram illustrating a condensing light distribution pattern.

The condensing unit 12 drives the condensing oblique lower emitting unit 21 of the condensing oblique unit 14 and the condensing horizontal lower emitting unit 31 of the condensing horizontal unit 15. As illustrated in FIG. 6, the condensing unit 12 simultaneously forms the first condensing oblique lower pattern 63, the second condensing oblique lower pattern 64, and the condensing horizontal lower pattern 66. When the lower patterns (63, 64, 66) are simultaneously formed, the lower patterns are overlapped with each other as appropriate near the center so that the oblique portion Cls and the horizontal portion Clh are connected to form the cutoff line Cl. Therefore, the lower patterns (63, 64, 66) are a condensing lower pattern that is a lower portion of the condensing light distribution pattern 60 formed by the condensing unit 12 and are the passing light distribution pattern LP having the cutoff line Cl formed at the upper end. The condensing oblique lower emitting unit 21 and the condensing horizontal lower emitting unit 31 function as a condensing lower emitting unit that forms the condensing lower pattern of the condensing light distribution pattern 60.

The condensing unit 12 drives the condensing oblique upper emitting unit 22 of the condensing oblique unit 14 and the condensing horizontal upper emitting unit 32 of the condensing horizontal unit 15. Accordingly, the condensing unit 12 simultaneously forms the condensing oblique upper pattern 65, the first condensing horizontal upper pattern 67, and the second condensing horizontal upper pattern 68. When the upper patterns (65, 67, 68) are simultaneously formed, the upper patterns are overlapped with each other as appropriate near the center to illuminate the area above the cutoff line Cl with substantially no gap between it and the lower patterns (63, 64, 66). Therefore, the upper patterns (65, 67, 68) are a condensing upper pattern that is an upper portion of the condensing light distribution pattern 60 formed by the condensing unit 12 and are the traveling light distribution pattern HP to illuminate the area above the cutoff line Cl. The condensing oblique upper emitting unit 22 and the condensing horizontal upper emitting unit 32 function as a condensing upper emitting unit that forms the condensing upper pattern of the condensing light distribution pattern 60. The condensing oblique projection lens 24 and the condensing horizontal projection lens 34 function as a condensing projection lens that projects the light emitted from the condensing upper emitting unit and the condensing lower emitting unit to the front side in the optical axis direction.

Figure 7:
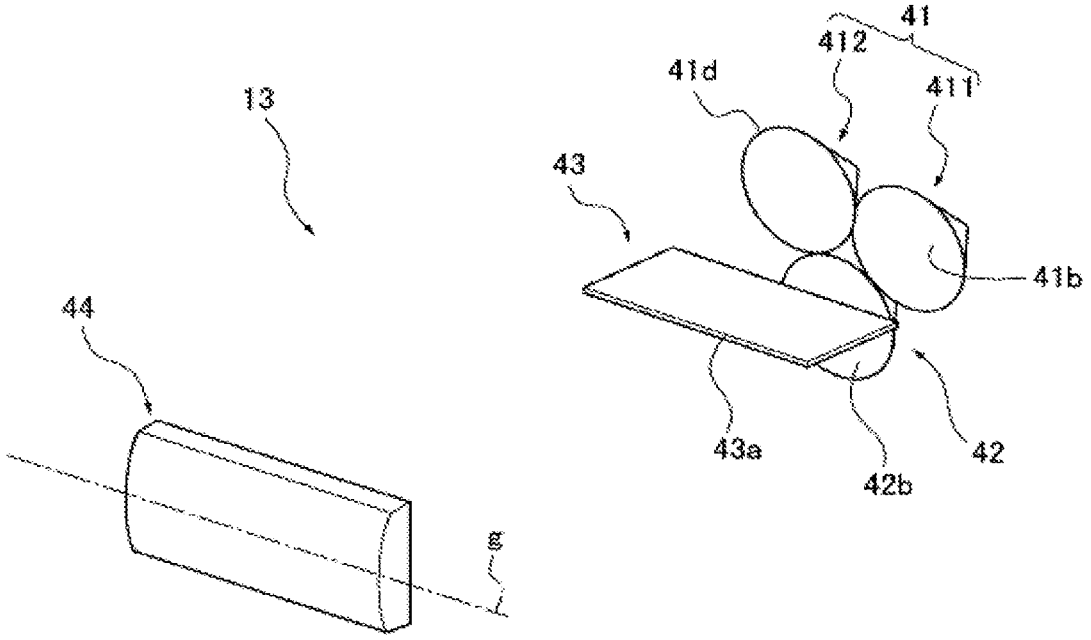
FIG. 7 is an explanatory diagram illustrating a diffusion unit.

As illustrated in FIG. 7, the diffusion unit 13 includes a diffusion lower emitting unit 41, a diffusion upper emitting unit 42, a diffusion shade 43, and a diffusion projection lens 44. The diffusion lower emitting unit 41 includes a first diffusion lower emitting unit 411 including a first lower light source 41*a* (see FIG. 1) and a first lower lens 41*b* and a second diffusion lower emitting unit 412 including a second lower light source 41*c* (see FIG. 1) and a second lower lens 41*d*. The first diffusion lower emitting unit 411 and the second diffusion lower emitting unit 412 are arranged side by side in the horizontal direction.

The first lower light source 41*a* and the second lower light source 41*c* each include a light emitting element such as an LED and are mounted on the same board. The board may feed the electric power from the lighting control circuit to the first lower light source 41*a* and the second lower light source 41*c* as appropriate to turn on the first lower light source 41*a* and the second lower light source 41*c* all together or individually as appropriate.

The first lower lens 41*b* corresponds to the first lower light source 41*a* and is provided on the front side of the first lower light source 41*a* in the optical axis direction. The first lower lens 41*b* has a short focal length as compared with the lenses (21*b*, 21*d*, 22*b*, 31*b*, 32*b*, 32*d*) of the condensing unit 12 and has a short distance to the diffusion projection lens 44 as compared with the emitting units (211, 212, 22, 31, 321, 322) of the condensing unit 12 (see FIG. 1). When viewed on the cross-section perpendicular to the vertical direction, the first lower lens 41*b* has a free-form surface based on an ellipse having a first focal point positioned near the first lower light source 41*a* and a second focal point positioned near an end 43*a* of the diffusion shade 43. When viewed on the cross-section perpendicular to the horizontal direction, the first lower lens 41*b* has substantially a paraboloidal surface having the focal point positioned near the first lower light source 41*a*. The first lower lens 41*b* has an optical design to form the light emitted from the first lower light source 41*a* so as to form the first diffusion lower pattern 71 (see FIG. 8) in cooperation with the diffusion projection lens 44. The first diffusion lower pattern 71 according to the first embodiment is to illuminate the area that is diagonally rightward and downward of the cutoff line Cl and that is wider than the lower patterns (63, 64, 66 (see FIG. 6)) downward and horizontally.

The second lower lens 41*d* corresponds to the second lower light source 41*c* and is provided on the front side of the second lower light source 41*c* in the optical axis direction. The second lower lens 41*d* has the same configuration as that of the first lower lens 41*b* except that the second lower lens 41*d* corresponds to the second lower light source 41*c* instead of the first lower light source 41*a*. The second lower lens 41*d* has an optical design to form the light emitted from the second lower light source 41*c* so as to form the second diffusion lower pattern 72 (see FIG. 8) in cooperation with the diffusion projection lens 44. The second diffusion lower pattern 72 according to the first embodiment is to illuminate the area having substantially the same shape and the same size as the first diffusion lower pattern 71 and to illuminate the area including part of the first diffusion lower pattern 71 and the side to the left of the first diffusion lower pattern 71.

The diffusion upper emitting unit 42 is provided in a lower area between the first diffusion lower emitting unit 411 and the second diffusion lower emitting unit 412. When viewed from the front side in the optical axis direction, the diffusion upper emitting unit 42 is provided to have a triangular positional relationship with the two lower emitting units (411, 412).

The diffusion upper emitting unit 42 includes an upper light source 42*a* (see FIG. 1) and an upper lens 42*b*. The upper light source 42*a* includes a light emitting element such as an LED and is mounted on the board on which the first lower light source 41*a* and the second lower light source 41*c* are mounted. The board may also feed an electric power from the lighting control circuit to the upper light source 42*a* as appropriate so as to turn on the upper light source 42*a* together with or separately from the first lower light source 41*a* and the second lower light source 41*c*. The light sources (41*a*, 41*c*, 42*a*) may be provided on different boards, or only two of the light sources may be provided on the same board; thus, the configuration according to the first embodiment is not a limitation.

The upper lens 42*b* corresponds to the upper light source 42*a* and is provided on the front side of the upper light source 42*a* in the optical axis direction. The upper lens 42*b* has the same configuration as that of the first lower lens 41*b* except that the upper lens 42*b* corresponds to the upper light source 42*a* instead of the first lower light source 41*a*. The upper lens 42*b* has an optical design to form the light emitted from the upper light source 42*a* so as to form a diffusion upper pattern 73 (see FIG. 8) in cooperation with the diffusion projection lens 44. The diffusion upper pattern 73 according to the first embodiment is to illuminate the semi-circular elongated area that is in the middle position of the first diffusion lower pattern 71 and the second diffusion lower pattern 72 and that is above the lower patterns (71, 72).

The diffusion shade 43 is a thin plate-shaped member to block part of the light emitted from the diffusion lower emitting unit 41 so as to form the upper edge of the first diffusion lower pattern 71 and the second diffusion lower pattern 72. It is assumed that the upper edge extends below the horizontal portion Clh of the cutoff line Cl of the passing light distribution pattern LP (see FIG. 9) along the horizontal portion Clh. The diffusion shade 43 is provided in front of the diffusion lower emitting unit 41 and the diffusion upper emitting unit 42, is located at the position corresponding to the position between the diffusion lower emitting unit 41 and the diffusion upper emitting unit 42, and is arranged parallel to the direction in which the two lower emitting units (411, 412) are arranged so as to be parallel to the horizontal plane. As the diffusion shade 43 is provided to have the above-described positional relationship according to the first embodiment, it is assumed that the diffusion shade 43 also blocks part of the light emitted from the diffusion upper emitting unit 42 so that the lower end of the diffusion upper pattern 73 has a linear shape along the horizontal portion Clh (See FIG. 8).

The diffusion projection lens 44 projects the light emitted from the two lower emitting units (411, 412) and the diffusion upper emitting unit 42 toward the front side of the vehicle. The diffusion projection lens 44 according to the first embodiment includes a cylindrical lens that extends in the width direction and has a refractive power exclusively in the vertical direction, has the generating line g extending along the horizontal direction (see FIG. 10), and has a rear focus line that is set near the end 43*a* of the condensing diffusion shade 43 and is set along the end 43*a*. The diffusion projection lens 44 according to the first embodiment has, when viewed from the front side in the optical axis direction, a rectangular shape on the projection surface, and the shape is substantially identical to the shape of the condensing oblique projection lens 24 and the condensing horizontal projection lens 34 on the projection surface (see FIG. 10). The diffusion projection lens 44 forms the first diffusion lower pattern 71 with the light from the first diffusion lower emitting unit 411, forms the second diffusion lower pattern 72 with the light from the second diffusion lower emitting unit 412, and forms the diffusion upper pattern 73 with the light from the diffusion upper emitting unit 42 (see FIG. 8).

Figure 10:
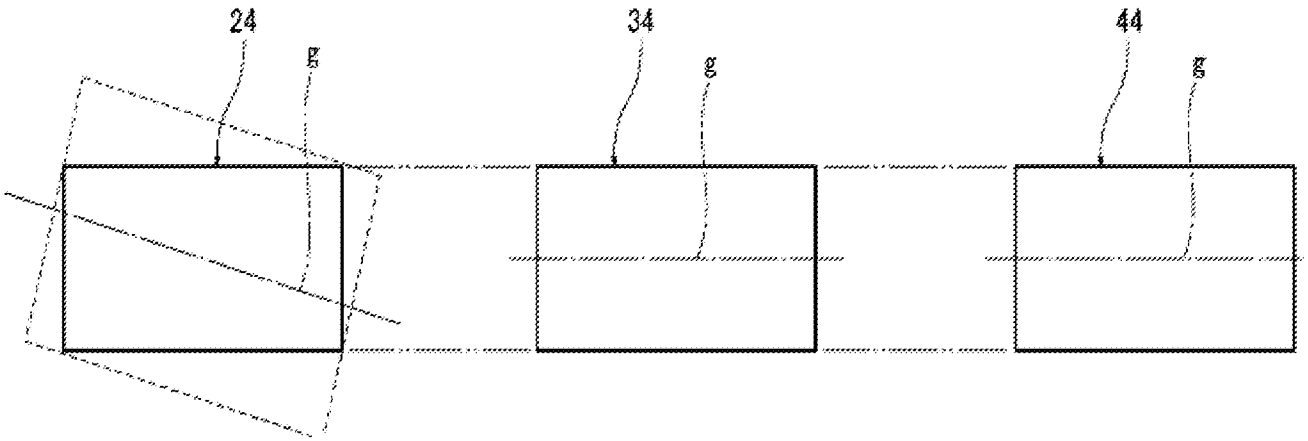
FIG. 10 is an explanatory diagram illustrating the appearance of three projection lenses arranged in a horizontal direction when viewed from a front side in an optical axis direction.

The diffusion unit 13 is formed by fixing the diffusion lower emitting unit 41, the diffusion upper emitting unit 42, the diffusion shade 43, and the diffusion projection lens 44 to a fixing member in the above-described positional relationship. As the fixing member, for example, a heatsink may be used, which is a heat release member that releases the heat generated by each of the light sources (41*a*, 41*c*, 42*a*) of the diffusion lower emitting unit 41 and the diffusion upper emitting unit 42 to the outside. As illustrated in FIGS. 1 and 10, in the diffusion unit 13, the diffusion projection lens 44 is arranged, in the same orientation and in a row in the horizontal direction, together with the condensing oblique projection lens 24 of the condensing oblique unit 14 and the condensing horizontal projection lens 34 of the condensing horizontal unit 15, which are arranged side by side in a straight line in the horizontal direction. According to the first embodiment, the condensing oblique projection lens 24, the condensing horizontal projection lens 34, and the diffusion projection lens 44 are integrally formed (see the chain double-dashed line in FIGS. 1 and 10). Although the generating line g of the condensing oblique projection lens 24 is tilted with respect to the horizontal direction, the condensing oblique projection lens 24 has a horizontally elongated and substantially rectangular shape on the projection surface when viewed from the front side in the optical axis direction as described above, as is the case with the other two projection lenses 34 and 44, and therefore the three rectangular shapes identical to one another may be arranged in a row. The same shapes of the three projection lenses 24, 34, and 44 on the projection surface does not necessarily refer to a completely match but may be the shape (primarily the outer shape) that seems to be identical when viewed from the front side in the optical axis direction.

Figure 8:
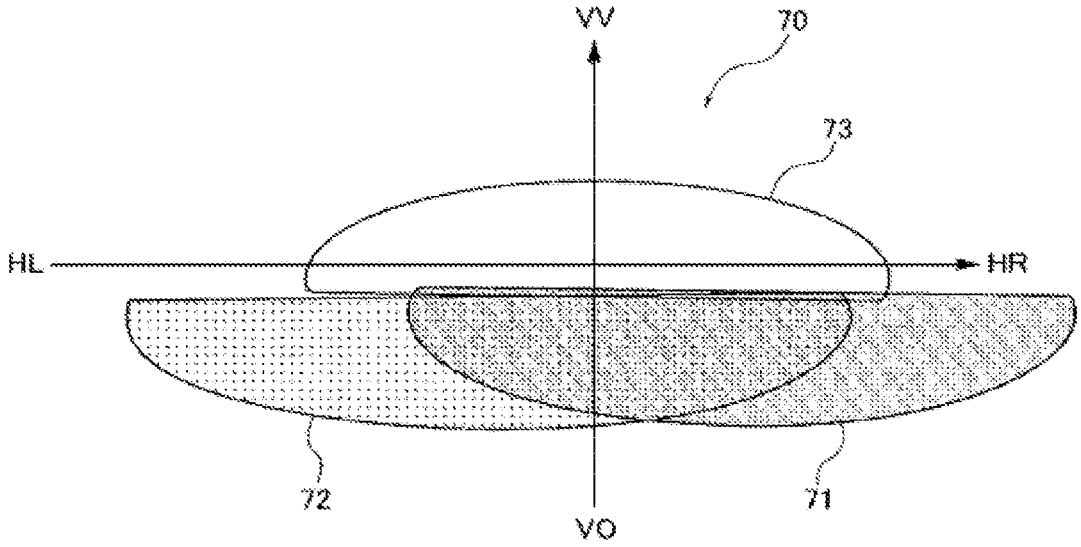
FIG. 8 is an explanatory diagram illustrating a diffusion light distribution pattern.

In the diffusion unit 13, the electric power from the lighting control circuit is supplied from the board to each of the light sources (41*a*, 41*c*, 42*a*) to turn on the emitting units (411, 412, 42) all together or individually as appropriate so as to form the above-described light distribution patterns (71, 72, 73) all together or individually as illustrated in FIG. 8. The first diffusion lower pattern 71 and the second diffusion lower pattern 72 are formed to be overlapped with each other near the center and misaligned to right and left. When the two diffusion lower patterns (71, 72) are simultaneously formed, it is possible to illuminate a wide area on right and left.

The diffusion unit 13 drives the two lower emitting units (411, 412). Accordingly, the diffusion unit 13 simultaneously forms the first diffusion lower pattern 71 and the second diffusion lower pattern 72. When the two lower patterns (71, 72) are simultaneously formed, the lower patterns are overlapped with each other as appropriate near the center to illuminate the area that is slightly under the lower patterns (63, 64, 66) of the diffusion light distribution pattern 70 formed by the condensing unit 12 and that is wider than the lower patterns (63, 64, 66). Thus, the two lower patterns (71, 72) are the passing light distribution pattern LP to illuminate downward in the diffusion light distribution pattern 70.

The diffusion unit 13 drives the diffusion upper emitting unit 42. Accordingly, the diffusion unit 13 forms the diffusion upper pattern 73. When the diffusion upper pattern 73 is formed simultaneously with the two lower patterns (71, 72), the diffusion upper pattern 73 illuminates the area above the two lower patterns (71, 72) with substantially no gaps in between. Therefore, the diffusion upper pattern 73 is the traveling light distribution pattern HP that illuminates the area above in the diffusion light distribution pattern 70 formed by the diffusion unit 13.

Figure 9:
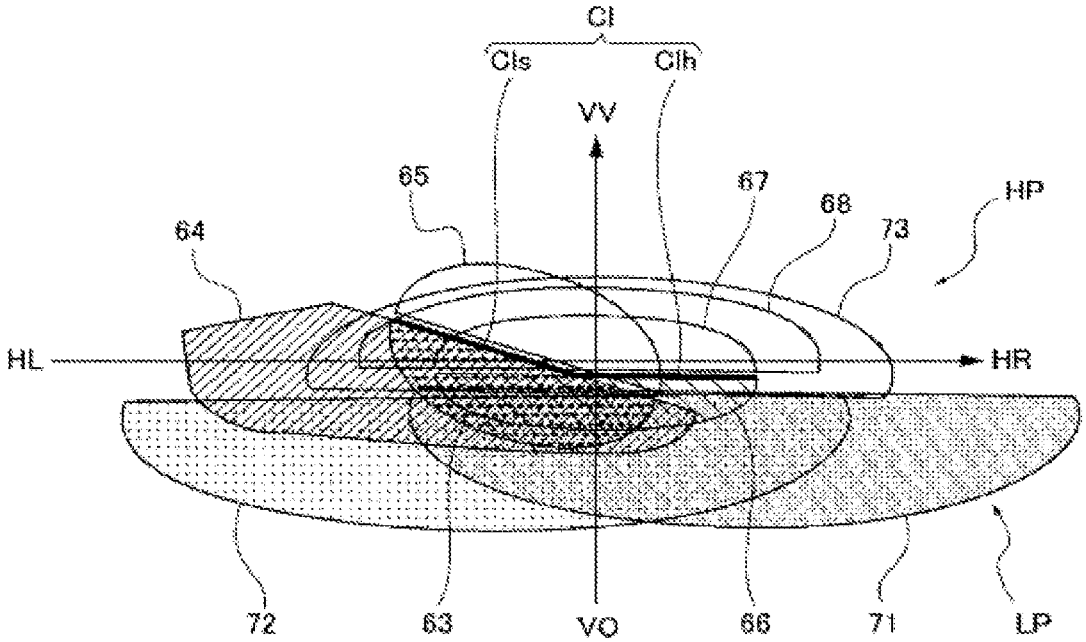
FIG. 9 is an explanatory diagram illustrating a traveling light distribution pattern and a passing light distribution pattern formed by the vehicular lamp.

The vehicular lamp 10 simultaneously drives the condensing oblique lower emitting unit 21 of the condensing oblique unit 14 of the condensing unit 12, the condensing horizontal lower emitting unit 31 of the condensing horizontal unit 15, and the diffusion lower emitting unit 41 of the diffusion unit 13. Accordingly, as illustrated in FIG. 9, the vehicular lamp 10 simultaneously forms the first condensing oblique lower pattern 63, the second condensing oblique lower pattern 64, and the condensing horizontal lower pattern 66 of the condensing light distribution pattern 60 and the first diffusion lower pattern 71 and the second diffusion lower pattern 72 of the diffusion light distribution pattern 70. Thus, the vehicular lamp 10 forms the passing light distribution pattern LP having the clear cutoff line Cl shaped by connecting the oblique edge and the horizontal edge to illuminate a wide area on the right and left.

The vehicular lamp 10 simultaneously drives the condensing oblique upper emitting unit 22 of the condensing oblique unit 14 of the condensing unit 12, the condensing horizontal upper emitting unit 32 of the condensing horizontal unit 15, and the diffusion upper emitting unit 42 of the diffusion unit 13. Accordingly, the vehicular lamp 10 simultaneously forms the condensing oblique upper pattern 65, the first condensing horizontal upper pattern 67, and the second condensing horizontal upper pattern 68 of the condensing light distribution pattern 60 and the diffusion upper pattern 73 of the diffusion light distribution pattern 70. Thus, the vehicular lamp 10 forms the traveling light distribution pattern HP that is arranged above the cutoff line Cl with substantially no gap from the passing light distribution pattern LP to illuminate a wide area on the right and left.

Therefore, the vehicular lamp 10 drives the lower emitting units (211, 212, 31, 411, 412) in the condensing unit 12 and the diffusion unit 13 so as to form the passing light distribution pattern LP. The vehicular lamp 10 drives the upper emitting units (22, 321, 322, 42) in the condensing unit 12 and the diffusion unit 13 so as to form the traveling light distribution pattern HP. The vehicular lamp 10 selectively drives the lower emitting units and the upper emitting units in the condensing unit 12 and the diffusion unit 13 so as to selectively form the passing light distribution pattern LP and the traveling light distribution pattern HP. The vehicular lamp 10 simultaneously forms the passing light distribution pattern LP and the traveling light distribution pattern HP during the normal traveling and exclusively forms the passing light distribution pattern LP when, for example, there is a vehicle coming from the opposite direction. As compared with the conventional configuration, it is possible to prevent an increase in size and weight as the vehicular lamp 10 does not need to include a drive mechanism that displaces the shade. The conventional configuration needs to properly fix the shade at the position for blocking part of the light so as to form the cutoff line of the passing light distribution pattern. With the conventional configuration, therefore, it is considered that the drive mechanism is configured by using a solenoid or a motor and, in order to properly fix the shade as described above, there is an increase in the size and the weight of the drive mechanism.

The vehicular lamp 10 forms the passing light distribution pattern LP by using the lower patterns (63, 64, 66, 71, 72); thus, with the simple configuration of setting the position, the shape, and the degree of overlapping of each of the lower patterns, it is possible to form the cutoff line Cl and set the brightness distribution and the shape of the passing light distribution pattern LP in a detailed manner.

The vehicular lamp 10 is configured such that the condensing oblique unit 14, the condensing horizontal unit 15, and the diffusion unit 13 are arranged side by side in the horizontal direction. Therefore, in the vehicular lamp 10, the condensing oblique projection lens 24, the condensing horizontal projection lens 34, and the diffusion projection lens 44, which are provided in the condensing oblique unit 14, the condensing horizontal unit 15, and the diffusion unit 13, respectively, are arranged side by side in the horizontal direction. The shapes of the projection lenses (24, 34, 44) on the projection surface viewed from the front side in the optical axis direction are rectangular shapes identical to one another; therefore, when the projection lenses (24, 34, 44) are arranged in the horizontal direction, the three same rectangular shapes are arranged in a row so as to give a sophisticated appearance (see FIG. 10). In particular, according to the first embodiment, as the three projection lenses (24, 34, 44) are integrally formed, the appearance may be made more sophisticated (see FIG. 10). The arrangement order, the arrangement direction, and the positional relationship of the projection lenses (24, 34, 44) may be set as appropriate as long as the traveling light distribution pattern HP and the passing light distribution pattern LP may be formed as described above, and the configuration according to the first embodiment is not a limitation. The projection lenses may be formed and arranged separately, and the configuration according to the first embodiment is not a limitation.

The vehicular lamp 10 includes the units (12, 13) that includes the emitting units (21, 22, 31, 32, 41, 42) including the light sources (21*a*, 21*c*, 22*a*, 31*a*, 32*a*, 32*c*, 41*a*, 41*c*, 42*a*) and the lenses (21*b*, 21*d*, 22*b*, 31*b*, 32*b*, 32*d*, 41*b*, 41*d*, 42*b*). In the vehicular lamp 10, the lens forms the light from the light source in accordance with the patterns (63 to 68, 71 to 73) formed by each emitting unit in each unit, and each of the projection lenses (24, 34, 44) adjusts the size of the light in the vertical direction while projecting the light to the front side in the optical axis direction. As the vehicular lamp 10 makes it possible to reduce the function required for the projection lens in each unit, the shape of each projection lens on the projection surface viewed from the front side in the optical axis direction may be a shape other than a circular shape (a rectangular shape according to the first embodiment) so as to give a more sophisticated appearance. The shape of each projection lens on the projection surface viewed from the front side in the optical axis direction may be set as appropriate, and the configuration according to the first embodiment is not a limitation.

The vehicular lamp 10 according to the first embodiment may achieve each of the following advantages.

In the vehicular lamp 10, the condensing unit 12 includes the condensing upper emitting units (22, 32) that emit the light for forming the condensing upper patterns (65, 67, 68), the condensing lower emitting units (21, 31) that emit the light for forming the condensing lower patterns (63, 64, 66), and the condensing projection lenses (24, 34) that project the light emitted from the two emitting units to the front side in the optical axis direction. In the vehicular lamp 10, the diffusion unit 13 includes the diffusion upper emitting unit 42 that emits the light for forming the diffusion upper pattern 73, the diffusion lower emitting unit 41 that emits the light for forming the diffusion lower pattern (71, 72), and the diffusion projection lens 44 that projects the light emitted from the two emitting units (42, 41) to the front side in the optical axis direction. The vehicular lamp 10 uses the condensing lower pattern and the diffusion lower pattern to form the passing light distribution pattern LP and uses the condensing upper pattern and the diffusion upper pattern 73 to form the traveling light distribution pattern HP. Thus, the vehicular lamp 10 may switch between the passing light distribution pattern LP and the traveling light distribution pattern HP without providing a drive mechanism that displaces the shade, and therefore it is possible to prevent an increase in size and weight.

In the vehicular lamp 10, the condensing unit 12 includes the condensing oblique unit 14 that forms the condensing oblique lower patterns (63, 64) including the oblique cutoff line Cl. Thus, the vehicular lamp 10 uses a simple configuration to form the oblique cutoff line Cl.

In the vehicular lamp 10, the condensing unit 12 includes the condensing horizontal unit 15 that forms the condensing horizontal lower pattern 66 including the horizontal cutoff line Cl. Thus, the vehicular lamp 10 uses a simple configuration to form the horizontal cutoff line Cl.

In the vehicular lamp 10, each emitting unit (21, 22, 31, 32, 41, 42) individually includes the light source (21*a*, 21*c*, 22*a*, 31*a*, 32*a*, 32*c*, 41*a*, 41*c*, 42*a*) and the lens (21*b*, 21*d*, 22*b*, 31*b*, 32*b*, 32*d*, 41*b*, 41*d*, 42*b*) that forms the light from the light source. Therefore, the vehicular lamp 10 may use the emitting units to easily form patterns having different shapes or positions. Furthermore, the vehicular lamp 10 makes it possible to reduce the function required for the projection lens in each unit, improve the flexibility of the shape of each projection lens on the projection surface viewed from the front side in the optical axis direction, and obtain a more sophisticated appearance.

In the vehicular lamp 10, either of the condensing upper emitting unit and the condensing lower emitting unit includes two pairs of a light source and a lens, and either of the diffusion upper emitting unit 42 and the diffusion lower emitting unit 41 includes two pairs of a light source and a lens. Therefore, the vehicular lamp 10 may form the cutoff line Cl with a simple configuration and set the brightness distribution and the shape in a more detailed manner in the formed pattern.

In the vehicular lamp 10, the condensing shade (23, 33) is provided between the condensing upper emitting unit and the condensing lower emitting unit on the front side thereof in the optical axis direction, and the diffusion shade 43 is provided between the diffusion upper emitting unit 42 and the diffusion lower emitting unit 41 on the front side thereof in the optical axis direction. Therefore, the vehicular lamp 10 may use a simple configuration to properly set the upper limit position (including the cutoff line Cl) of each lower pattern of the condensing light distribution pattern 60 and the diffusion light distribution pattern 70 and form the appropriate passing light distribution pattern LP.

In the vehicular lamp 10, the condensing projection lenses and the diffusion projection lens 44 are formed as a cylindrical lens having a refractive power exclusively in the vertical direction (the direction in which the condensing oblique projection lens 24 has a refractive power is tilted with respect to the vertical direction as described above according to the first embodiment). Therefore, the vehicular lamp 10 makes it possible to adjust the size of the formed pattern in the vertical direction by using each projection lens and therefore simplify the optical design for forming a pattern by each emitting unit.

In the vehicular lamp 10, the condensing projection lenses and the diffusion projection lens 44 have shapes identical to one another on the projection surface viewed from the front side in the optical axis direction. Therefore, the vehicular lamp 10 has the same external appearance of the units (12 (14, 15), 13) having different functions and a sophisticated appearance.

Thus, the vehicular lamp 10 according to the first embodiment, which is the vehicular lamp 10 according to the present disclosure, may switch between the passing light distribution pattern LP and the traveling light distribution pattern HP while preventing an increase in size and weight.

Although the vehicular lamp according to the present disclosure is described above based on the first embodiment, a specific configuration is not limited to the first embodiment, and modifications, additions, and the like, may be made to the design without departing from the gist of the invention according to the scope of patent claims.

According to the first embodiment, the condensing projection lenses (24, 34) and the diffusion projection lens 44 are formed as a cylindrical lens. However, the vehicular lamp 10 is not limited to the configuration according to the first embodiment as long as the light emitted from each emitting unit (21, 22, 31, 32, 41, 42) is projected to the front side in the optical axis direction. According to another example, for example, the configuration illustrated in FIG. 11A or FIG. 11B may be used. Although FIG. 11A and FIG. 11B illustrate, for example, a state where a condensing oblique projection lens 24A, which is used instead of the condensing oblique unit 14, is viewed in the vertical direction, the same configuration may be used for the condensing horizontal projection lens 34 used in the condensing horizontal unit 15 or the diffusion projection lens 44 used in the diffusion unit 13. It is assumed that an exit surface 24*a* of the condensing oblique projection lens 24A on the front side in the optical axis direction has a refractive power exclusively in the vertical direction, an entrance surface 24*b* thereof on the rear side in the optical axis direction has a refractive power exclusively in the horizontal direction, and the condensing oblique projection lens 24A is tilted in the same manner as the condensing oblique projection lens 24 according to the first embodiment. Specifically, the exit surface 24*a* of the condensing oblique projection lens 24A is a convex surface or a concave surface and has the same function as that of the condensing oblique projection lens 24 according to the first embodiment, and the entrance surface 24*b* has a function different from that of the condensing oblique projection lens 24. The entrance surface 24*b* adjusts the size of the light emitted from each of the above-described emitting units in the horizontal direction. The entrance surface 24*b* of the condensing oblique projection lens 24A illustrated on the upper section is a convex surface to reduce the size of the light emitted from each emitting unit in the horizontal direction. The entrance surface 24*b* of the condensing oblique projection lens 24A illustrated on the lower section is a concave surface to enlarge the size of the light emitted from each emitting unit in the horizontal direction. As the condensing oblique projection lens 24A may use the entrance surface 24*b* to adjust the size of the light emitted from each emitting unit in the horizontal direction, it is possible to adjust the formed pattern more easily and simplify the optical design for forming the pattern by each light emitting unit. Furthermore, as the condensing oblique projection lens 24A has the above-described function with the exit surface 24*a* and the entrance surface 24*b* that are a convex surface or a concave surface, the shape on the projection surface viewed from the front side in the optical axis direction may be a rectangular shape similar to that of the condensing oblique projection lens 24, whereby a more sophisticated appearance may be obtained.

According to the first embodiment, the condensing unit 12 includes the two units (14, 15). However, the vehicular lamp 10 is not limited to the configuration according to the first embodiment as long as the vehicular lamp 10 includes the condensing unit 12 forming the condensing light distribution pattern 60 and the diffusion unit 13 forming the diffusion light distribution pattern 70.

According to the first embodiment, each of the units (12 (14, 15), 13) includes the three emitting units (211, 212, 22, 31, 321, 322, 411, 412, 42). However, the vehicular lamp 10 is not limited to the configuration according to the first embodiment as long as each unit includes an upper emitting unit that emits light for forming an upper pattern and a lower emitting unit that emits light for forming a lower pattern.

DESCRIPTION OF REFERENCE SIGNS

10 Vehicular lamp
12 Condensing unit

13 Diffusion unit
14 Condensing oblique unit
15 Condensing horizontal unit
21 Condensing oblique lower emitting unit (example of condensing lower emitting unit)
22 Condensing oblique upper emitting unit (example of condensing upper emitting unit)
23 Condensing oblique shade (example of condensing shade)
24 Condensing oblique projection lens (example of condensing projection lens)
24*a* Exit surface
24*b* Entrance surface
31 Condensing horizontal lower emitting unit (example of condensing lower emitting unit)
32 Condensing horizontal upper emitting unit (example of condensing upper emitting unit)
33 Condensing horizontal shade (example of condensing shade)
34 Condensing horizontal projection lens (example of condensing projection lens)
41 Diffusion lower emitting unit
42 Diffusion upper emitting unit
21*a*, 21*c*, 22*a*, 31*a*, 32*a*, 32*c*, 41*a*, 41*c*, and 42*a* Light source
21*b*, 21*d*, 22*b*, 31*b*, 32*b*, 32*d*, 41*b*, 41*d*, and 42*b* Lens
43 Diffusion shade
44 Diffusion projection lens
60 Condensing light distribution pattern
63 First condensing oblique lower pattern (example of condensing lower pattern)
64 Second condensing oblique lower pattern (example of condensing lower pattern)
66 Condensing horizontal lower pattern
65 Condensing oblique upper pattern (example of condensing upper pattern)
67 First condensing horizontal upper pattern (example of condensing upper pattern)
68 Second condensing horizontal upper pattern (example of condensing upper pattern)
70 Diffusion light distribution pattern
71 First diffusion lower pattern (example of diffusion lower pattern)
72 Second diffusion lower pattern (example of diffusion lower pattern)
73 Diffusion upper pattern
Cl Cutoff line
HP Traveling light distribution pattern
LP Passing light distribution pattern

The invention claimed is:

1. A vehicular lamp comprising:
a condensing unit that forms a condensing light distribution pattern and
a diffusion unit that forms a diffusion light distribution pattern that is formed in a wider area than the condensing light distribution pattern and that is at least partially overlapped with the condensing light distribution pattern, wherein
the condensing unit includes
a condensing upper emitting unit that emits light for forming a condensing upper pattern that is an upper portion of the condensing light distribution pattern,
a condensing lower emitting unit that emits light for forming a condensing lower pattern that is a lower portion of the condensing light distribution pattern, and
a condensing projection lens that projects light emitted from the condensing upper emitting unit and the condensing lower emitting unit to a front side in an optical axis direction,
the diffusion unit includes
a diffusion upper emitting unit that emits light for forming a diffusion upper pattern that is an upper portion of the diffusion light distribution pattern,
a diffusion lower emitting unit that emits light for forming a diffusion lower pattern that is a lower portion of the diffusion light distribution pattern, and
a diffusion projection lens that projects light emitted from the diffusion upper emitting unit and the diffusion lower emitting unit to the front side in the optical axis direction,
the condensing lower pattern and the diffusion lower pattern form a passing light distribution pattern, and
the condensing upper pattern and the diffusion upper pattern form a traveling light distribution pattern,
wherein the condensing upper emitting unit, the condensing lower emitting unit, the diffusion upper emitting unit, and the diffusion lower emitting unit individually include a light source and a lens that forms light from the light source.

2. The vehicular lamp according to claim 1, wherein the condensing unit includes a condensing oblique unit that forms a condensing oblique lower pattern having an oblique cutoff line.

3. The vehicular lamp according to claim 1, wherein the condensing unit includes a condensing horizontal unit that forms a condensing horizontal lower pattern having a horizontal cutoff line.

4. The vehicular lamp according to claim 1, wherein
at least either of the condensing upper emitting unit and the condensing lower emitting unit includes two pairs of the light source and the lens, and
at least either of the diffusion upper emitting unit and the diffusion lower emitting unit includes two pairs of the light source and the lens.

5. The vehicular lamp according to claim 1, comprising:
a condensing shade that is provided on the front side of the condensing upper emitting unit and the condensing lower emitting unit in the optical axis direction and is provided between the condensing upper emitting unit and the condensing lower emitting unit, and
a diffusion shade that is provided on the front side of the diffusion upper emitting unit and the diffusion lower emitting unit in the optical axis direction and is provided between the diffusion upper emitting unit and the diffusion lower emitting unit.

6. The vehicular lamp according to claim 1, wherein the condensing projection lens and the diffusion projection lens include a cylindrical lens having a refractive power exclusively in a vertical direction.

7. The vehicular lamp according to claim 1, wherein an exit surface of the condensing projection lens and the diffusion projection lens on the front side in the optical axis direction has a refractive power exclusively in the vertical direction and an entrance surface of the condensing projection lens and the diffusion projection lens on a rear side in the optical axis direction has a refractive power exclusively in a horizontal direction.

8. The vehicular lamp according to claim 1, wherein the condensing projection lens and the diffusion projection lens have a shape identical to one another on a projection surface from the front side in the optical axis direction.

* * * * *